US010791806B2

(12) United States Patent
Cusin et al.

(10) Patent No.: US 10,791,806 B2
(45) Date of Patent: Oct. 6, 2020

(54) CLASP FOR WRISTWATCH

(71) Applicant: ROLEX SA, Geneva (CH)

(72) Inventors: Mathieu Cusin, Andilly (FR); Nicolas Dufraine, Pringy (FR); James Rejzner, Saint-Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 96 days.

(21) Appl. No.: 16/016,986

(22) Filed: Jun. 25, 2018

(65) Prior Publication Data

US 2018/0368540 A1 Dec. 27, 2018

(30) Foreign Application Priority Data

Jun. 26, 2017 (EP) ..... 17177805

(51) Int. Cl.
*A44C 5/20* (2006.01)
*A44C 5/24* (2006.01)

(52) U.S. Cl.
CPC ..... *A44C 5/2042* (2013.01); *A44C 5/24* (2013.01)

(58) Field of Classification Search
CPC ..... A44C 5/2042; A44C 5/24; A44C 5/2061; Y10T 24/2155; Y10T 24/4736; Y10T 24/4745; Y10T 24/4782
See application file for complete search history.

(56) References Cited

U.S. PATENT DOCUMENTS 2,444,360 A * 6/1948 Mauch ..... A44C 5/246 24/71 J
4,928,359 A * 5/1990 Gagnebin ..... A44C 5/2042 24/587.11
5,579,559 A * 12/1996 Ferrario ..... A44C 5/24 24/71 J (Continued)

FOREIGN PATENT DOCUMENTS

CH 663 522 A5 12/1987
CH 709 911 A1 1/2016

(Continued)

OTHER PUBLICATIONS

European Search Report and Written Opinion dated Nov. 7, 2017 issued in counterpart application No. EP17177805; w/ English machine translation (16 pages).

*Primary Examiner* — Robert Sandy
*Assistant Examiner* — David M Upchurch
(74) *Attorney, Agent, or Firm* — Westerman, Hattori, Daniels & Adrian, LLP

(57) ABSTRACT

A clasp having deployant blades for a wristband includes at least two blades (1, 2), one movable blade (1) being articulated on a second blade (2) in the area of first extremities, the clasp being able to adopt (i) a first closed configuration, in which the movable blade (1) exhibits a first predefined form (C1) and extends in a continuous manner for its entire length, substantially along the surface of the second blade (2); and the second extremity of the movable blade (1) is (Continued)

maintained in position by the clasp, and (ii) a second, deployed configuration, in which the second extremity of the movable blade (1) is free, and the movable blade (1) is able to exhibit a second predefined form (C2), different from the first predefined form (C1), in order to optimize the passage surface for the hand of a person wearing the clasp.

24 Claims, 7 Drawing Sheets

(56) References Cited

U.S. PATENT DOCUMENTS

| | | | | |
|---|---|---|---|---|
| 5,771,543 | A * | 6/1998 | Froidevaux | A44C 5/246 24/71 J |
| 7,124,478 | B2 | 10/2006 | Aquillon et al. | |
| 8,739,369 | B2 * | 6/2014 | Kaltenrieder | A44C 5/24 24/265 WS |
| 9,451,812 | B2 * | 9/2016 | Kaltenrieder | A44C 5/24 |
| 2002/0023320 | A1 * | 2/2002 | Thalheim | A44C 5/24 24/265 WS |
| 2006/0090305 | A1 | 5/2006 | Aquillon et al. | |
| 2006/0272134 | A1 * | 12/2006 | Turuani | A44C 5/24 24/71 J |
| 2007/0028586 | A1 * | 2/2007 | Grossiord | A44C 5/243 59/15 |
| 2007/0283537 | A1 * | 12/2007 | Dubois | A44C 5/24 24/71 J |
| 2013/0255043 | A1 * | 10/2013 | Mace | A44C 5/24 24/493 |

FOREIGN PATENT DOCUMENTS

| | | |
|---|---|---|
| EP | 0 344 620 A1 | 12/1989 |
| EP | 1 654 950 A1 | 5/2006 |
| JP | 53-166673 U | 12/1978 |

* cited by examiner

CLASP FOR WRISTWATCH

This application claims priority of European patent application No. EP17177805.3 filed Jun. 26, 2017, which is hereby incorporated by reference herein in its entirety.

INTRODUCTION

The present invention relates to a clasp for a wristwatch, as well as a wristband and a wristwatch per se comprising a suchlike clasp.

STATE OF THE ART

A plurality of solutions exist for the attachment of the two strands of a wristband around the wrist of its wearer. The first solution is simple and involves providing the extremities of each strand with means of cooperation, for example in the form of a simple buckle and a pin on the one hand cooperating with holes on the other hand. A suchlike solution exhibits the disadvantage that, in the course of opening the means of cooperation, the two strands of the wristband are immediately disassociated and entail a risk of the wristwatch falling.

In order to address this disadvantage, another solution involves the provision of an intermediate element of the clasp type, disposed between the two strands of the wristband, which element remains attached at all times to the extremities of said two strands. A suchlike clasp adopts two configurations: a closed configuration, intended for wearing the watch, in which the wristband and the clasp extend around the periphery of the wrist by exhibiting a total length permitting the wristwatch to be held securely, and an open or deployed configuration, which permits the length of the clasp, and therefore of the wristband, to be increased by moving apart the two extremities of the two strands of the wristband, but without detaching them from the clasp, in order to permit the passage of the hand and the removal of the watch. In this open configuration of the clasp, the two strands of the wristband are not disassociated, which minimizes the risk of the watch falling.

In a solution with a clasp, a first aim is to seek to ensure optimal comfort when wearing the wristband. In order to achieve this, it is advantageous for the clasp to conform as closely as possible to the contour of a wrist, including that of a small wrist, when the clasp is in its closed configuration. In parallel, a second aim is to obtain a large opening surface of the wristband in the deployed configuration of the clasp, in order to facilitate the passage of a hand, adapted for the passage of a hand having large dimensions. The two aforementioned aims may appear to be contradictory, since the blades of a clasp having small dimensions assist in the achievement of the first aim to the detriment of the second aim, which would instead require blades having larger dimensions. One difficulty encountered in the realization of a clasp is accordingly to define the compromise between the need to conform to the wrist of a person wearing a wristwatch in an adequate and comfortable manner and the need to offer a sufficiently large opening for the passage of the wearer's hand, irrespective of the dimensions of the hand and the wearer's wrist.

Document EP1654950 describes by way of example a clasp that is familiar from the prior art. A suchlike clasp is illustrated in FIGS. 1 to 3. It comprises two blades 1, 2 that are interconnected in an articulated manner about an axis A1 in the area of their first extremities. Each of these two blades 1, 2 comprises a coupling with respectively one strand 101, 102 of a wristband by means of a respective axis A2, A3 positioned in the area of their second extremity. The first blade 1, commonly referred to as the center blade, is more precisely coupled to a first strand 101 of a wristband 100 by means of a cover 3. FIG. 1 illustrates the deployed configuration of the clasp, in which the two blades 1, 2 are deployed, that is to say they form an obtuse angle, and extend substantially in a continuous manner about their axis of articulation A1 in order to maximize the total length of the wristband and to facilitate the passage of a hand. FIG. 2 illustrates an intermediate configuration, in which the first blade 1 has been moved closer to the second blade 2 by rotation about the axis of articulation A1, in such a way as to form an acute angle. FIG. 3 illustrates the closed configuration of the clasp, in which the blades 1, 2 are folded back onto each other, that is to say they form an essentially zero angle, and are retained in this configuration by a locking device, which includes a hook 6 arranged at the extremity of the first blade and cooperating with a coupling element carried by the second blade 2. A lever 4 carried by the cover 3 is adapted to actuate the locking device in order to permit its opening and its return to the deployed configuration.

A suchlike solution that is familiar from the prior art meets the requirement for comfort by the two blades 1, 2, which exhibit a substantially identical curve r1, r2 in order for them to be able to overlap one another in the closed configuration, while conforming as closely as possible to the form of a wrist. The first blade is a movable blade 1, which performs a rotation of substantially 180 degrees about its axis of articulation A1 between the two configurations, closed and deployed, of the clasp. The length of the two blades 1, 2 is designed so that they are also able to conform to the form of a small wrist. Finally, a suchlike solution that is familiar from the prior art is advantageous in the sense that it utilizes a user-friendly, intuitive and secure locking device which is particularly effective.

The effect of the limited length of the blades of the clasp is to limit the opening surface offered by the clasp in the deployed configuration, which may impede the passage of a hand, in particular in the case of a large hand. An increase in the length of the blades would not be a satisfactory solution because it could compromise the comfort of the wearer, especially in the case of a small wrist. Furthermore, no universal correlation exists, of course, between the size of the hand and that of the wrist of the person wearing a wristwatch, and no rule exists for optimizing the length of the blades according to the size of the wrist or the size of the hand.

Other solutions that are familiar from the prior art meet the contradictory requirements described above by multiplying the number of blades. However, such solutions have the disadvantages of complicating the construction, increasing its overall dimensions and making operation of the clasp difficult.

It is for this reason that the invention seeks to define a solution for a clasp enabling an optimal compromise to be achieved between the wearing comfort and a satisfactory opening for the passage of a hand.

In addition, the invention seeks to define a clasp having small overall dimensions, user-friendly operation and/or an attractive appearance.

BRIEF DESCRIPTION OF THE INVENTION

For this purpose, the invention is based on a clasp having deployant blades for a wristband, wherein the clasp comprises at least two blades, one movable blade being articulated on a second blade in the area of first extremities, the clasp being able to adopt a first closed configuration, in which:

The movable blade exhibits a first predefined form and extends in a continuous manner for its entire length, substantially along the surface of the second blade;

The second extremity of the movable blade is maintained in position by the clasp;

the clasp being able to adopt a second, deployed configuration, in which the second extremity of the movable blade is free, the movable blade thus having the ability to be moved away from the surface of the second blade, wherein, in the second deployed configuration, the movable blade is able to exhibit a second predefined form, different from the first predefined form, in order to optimize the passage surface for the hand of a person wearing the clasp.

The invention is defined precisely by the claims.

BRIEF DESCRIPTION OF THE FIGURES

These aims, characterizing features and advantages of the present invention are explained in detail in the following description of individual embodiments that is made without limitation in relation to the accompanying figures, among which.

Figure 1:
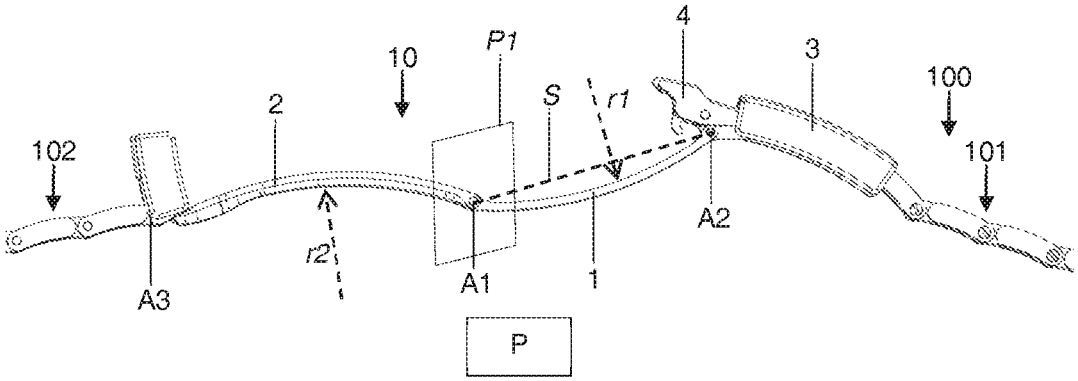
Related Art Figure 1
FIG. 1 depicts a view of a deployed clasp according to a solution that is familiar from the prior art.

It has been established that, in a solution that is familiar from the prior art, such as that illustrated in FIG. 1, the movable blade 1 having pivoted through substantially 180 degrees about its axis of articulation from the closed configuration of the clasp, it is in an inverted position facing the wrist compared with its position in the closed configuration, in which its curve r1 is thus inverted, such that it exhibits a substantially convex form when viewed from the wrist. This convexity of the blade 1 may cause an obstruction when it is a case of passing the wristwatch onto a wearer's wrist, in particular a wearer with a large hand. In fact, the blade 1 exhibits a form that may constitute an obstacle with the potential to make contact with the wearer's hand during passage of the watch.

The invention notably makes an improvement to a suchlike clasp that is familiar from the prior art by making it possible for at least one movable blade to exhibit a second predefined form, which is conducive to the passage of a hand. A suchlike movable blade in its second predefined form defines a favorable overall form of the clasp its deployed configuration, but without necessarily increasing the length of the blades of the clasp. This length is advantageously between 20 and 60 mm. However, a suchlike solution is based on at least one movable blade of a clasp, which exhibits a first predefined form adapted to the closed configuration of the clasp, and which may exhibit a second, different predefined form in a deployed configuration of a clasp in order to be conducive to the passage of a hand. A suchlike solution thus makes it possible to maintain the optimal comfort of the clasp in its closed configuration, while optimizing the surface for the passage of a wrist in the deployed configuration.

Three individual embodiments of a suchlike clasp are now described in a detailed manner without limitation. For the sake of simplicity, the same references are used to designate identical or equivalent elements in the different embodiments.

In a first variant of the first embodiment, represented by FIGS. 4 to 8, the clasp exhibits a structure that is very close overall to the solution that is familiar from the prior art described with reference to FIGS. 1 to 3, of which the identical or similar elements carry the same references and will not be described again in a detailed manner. The embodiment of the invention differs primarily from the state of the art in respect of its movable blade 1.

In fact, the movable blade 1 comprises two parts 11, 12 of substantially the same length that are interconnected in an articulated manner by an articulation A11. This articulation is angularly delimited by abutments 11*a*, 11*b* of the first part 11, cooperating with corresponding abutments 12*a*, 12*b* of the second part 12. These abutments define in an unambiguous manner first and second forms of the movable blade 1, in which the two parts 11, 12 occupy different respective positions.

Figure 4:
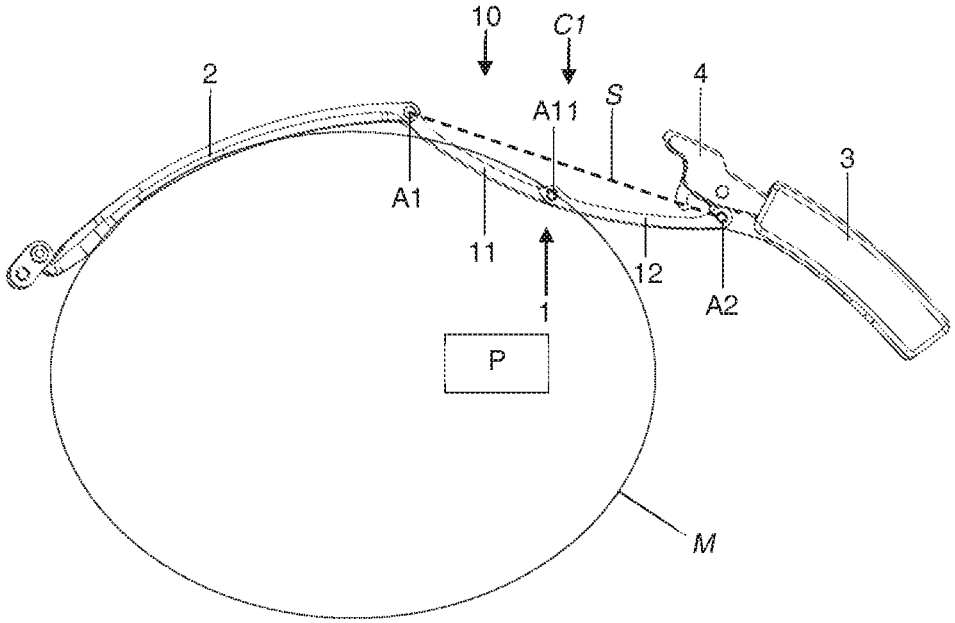
FIG. 4 depicts a view of a deployed clasp, in which a movable blade exhibits a first form according to a first variant of the first embodiment of the invention.

The movable blade 1 may, in fact, adopt a first form C1 adapted to the closed configuration of the clasp. This first form thus approaches closely to the form of the second blade 2, on which the movable blade 1 rests in the closed configuration of the clasp, as illustrated in particular by FIG. 8. FIG. 4 depicts the clasp in the deployed configuration, in which the movable blade 1 has retained its first form C1: in a suchlike form, the deployed clasp is similar to that which is familiar from the prior art depicted by FIG. 1. By its rotation about the axis of articulation A1, the movable blade 1 has inverted its position facing towards the wrist, and its concave, curved form when viewed from the wrist P in the closed configuration, intended to conform to the form of a wrist P, becomes convex when viewed from the wrist P once the angle between the two blades has become obtuse.

Figure 5:
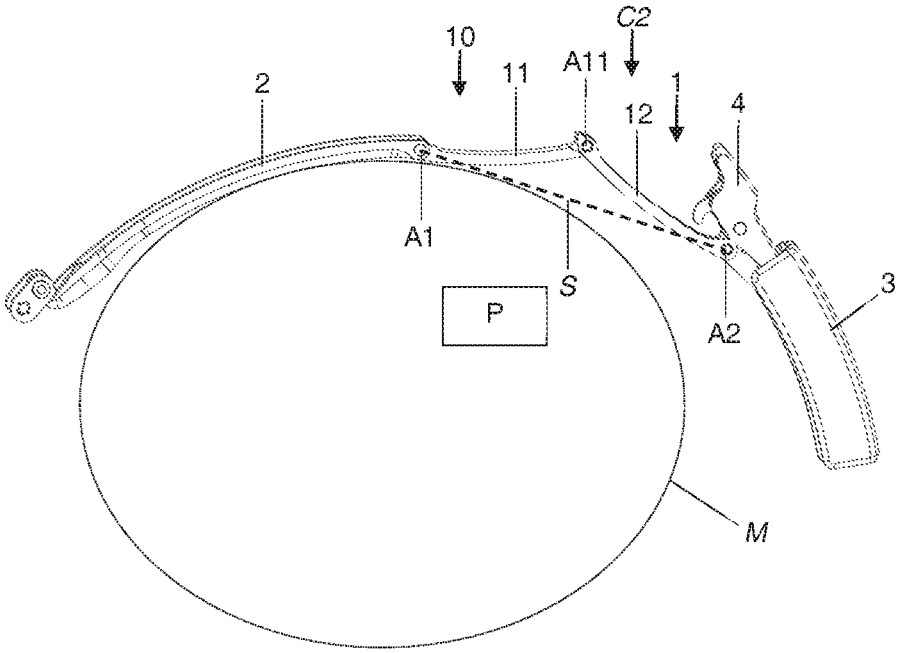
FIG. 5 depicts a view of the deployed clasp, in which the movable blade exhibits a second form according to the first variant of the first embodiment of the invention.

According to this embodiment, however, the movable blade 1 may exhibit a different predefined form C2, illustrated by FIG. 5, in which the two parts 11, 12 have been rotated about their axis of articulation A11. The effect of this rotation is to cause the axis of articulation A11, as well as the two parts 11, 12, to move further away from the wrist P. In this movement of the first predefined form C1 towards the second predefined form C2, the two parts 11, 12 of the movable blade 1, which were on the side of the wrist P in relation to the segment S connecting the two axes A1, A2 positioned at the two extremities of the movable blade 1 in its first form C1 illustrated in FIG. 4, are transferred beyond this segment S in the second form C2 of the movable blade, illustrated by FIG. 5. In its second form, the movable blade 1 thus projects beyond the segment S, in a view from the wrist P. In this second predefined form of the movable blade, its convexity is therefore eliminated. It even exhibits at least one concave portion. In its second form C2, the movable blade 1 no longer exhibits a form with the potential to constitute an obstacle or an obstruction to the passage of a hand. In addition, the deployed clasp thus defines a surface for the passage of a hand that is increased in size compared to this surface for the passage of a hand in the configuration of the clasp in FIG. 4. The distance to the segment S from the axis of articulation A11 is substantially identical in the two predefined forms C1, C2 of the movable blade, although the latter is positioned to either side of said segment S in these two forms. It should be noted that this characterizing feature makes it possible for the movable blade 1 in its second form C2 to extend the blade 2 with substantially the same curve when the clasp adopts its configuration in FIG. 5.

Figure 6:
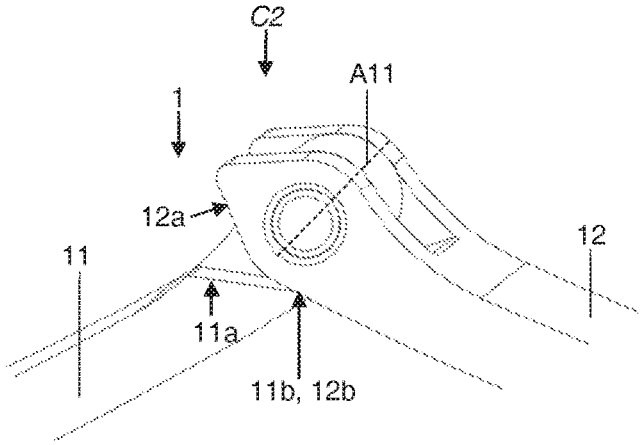
FIG. 6 depicts a detail of the movable blade of the clasp according to the first variant of the first embodiment of the invention.

The amplitude of the respective rotation of the two parts 11, 12 of the movable blade, as well as their two extreme positions, are perfectly predefined by the abutments provided on the parts 11, 12. In the second form C2 of the movable blade, the second abutments 11*b*, 12*b* of the parts 11, 12 respectively bear against one another, as illustrated in FIG. 6. In the first form C1 depicted by FIGS. 4 and 8, their first abutments 11*a*, 12*a* bear against one another. The amplitude of displacement of the parts 11, 12 of the movable blade 1 between their two predefined positions, corresponding to each of the predefined forms of the clasp, is preferably in the order of 60°. This amplitude is advantageously between 20° and 80° inclusive. This controlled amplitude or displacement of the rotation of the two parts 11, 12 of the movable blade makes it possible not only to permit the movable blade 1 to exhibit a second advantageous form, but also to be conducive to the user-friendly operation of the clasp. It should be noted that this displacement makes it possible to achieve the desired principal aim of optimizing the passage of a wearer's hand. Too little displacement will have little effect on the movable blade, which would retain the disadvantages that are familiar from the prior art. The effect of excessive displacement would be to reduce the opening surface of the deployed clasp, which would thus have an opposite effect to the sought effect.

Figure 2:
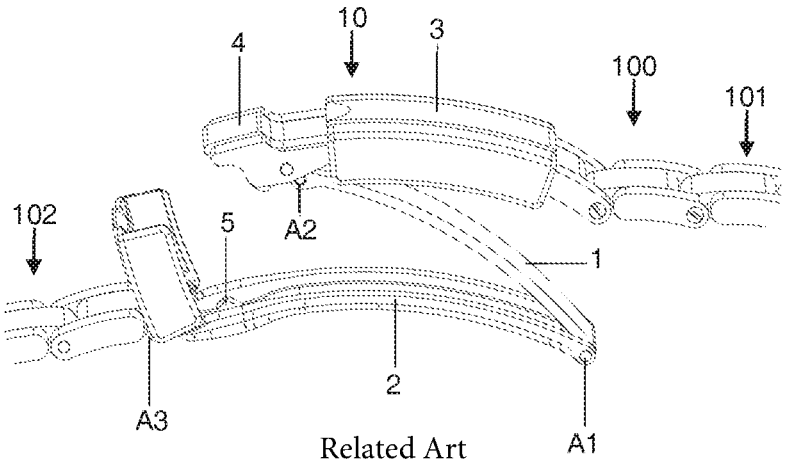
Related Art Figure 2
FIG. 2 depicts a view in perspective of the partially deployed clasp according to the solution that is familiar from the prior art.
Figure 3:
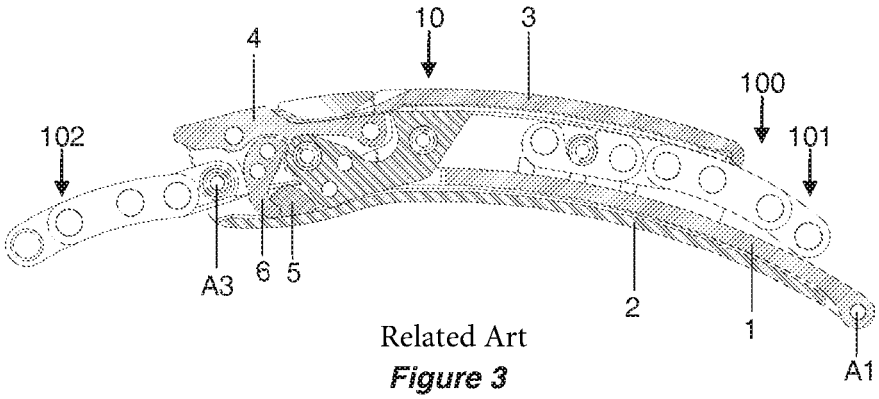
Related Art Figure 3
FIG. 3 depicts a view in section of the clasp according to the solution that is familiar from the prior art in the closed configuration.

The operation of a suchlike clasp according to the embodiment described above takes place in a similar manner to that of the clasp that is familiar from the prior art illustrated by FIGS. 1 to 3. Its opening from the closed configuration to the deployed configuration may initially result in the configuration depicted by FIG. 4. Contact by the wrist against the movable blade 1 may then bring about pivoting of the two parts 11, 12 until the eventual contact of their two abutments 11*b*, 12*b* in order to arrive at the second form of the movable blade, as depicted in FIG. 5.

Figure 7:
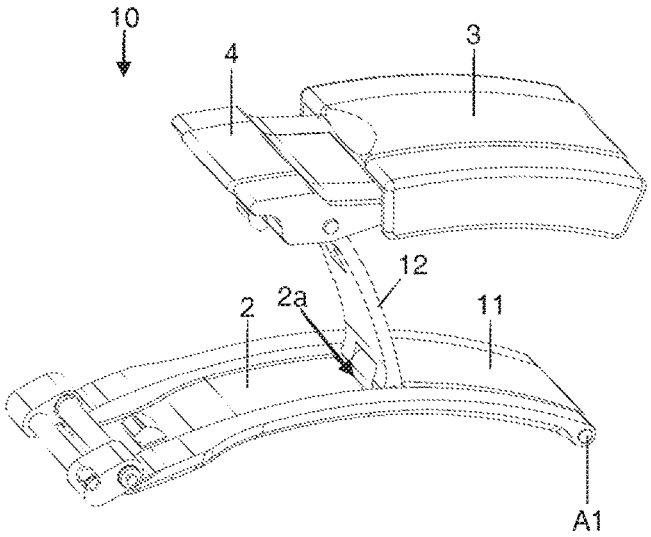
FIG. 7 depicts a view of the clasp according to the first variant of the first embodiment of the invention in an intermediate configuration.

Conversely, closing of the clasp includes the rotation of the movable blade 1 about the axis of articulation A1 as far as an intermediate configuration, of which an example is illustrated by FIG. 7, in which the first part 11 of the movable blade has arrived in its final position bearing against the second movable blade 2, while its second part 12 remains further away on account of the fact that the movable blade 1 has remained in its second form C2. The continuation of the same movement causes the rotation of said second part 12 about the axis of articulation A11, until the movable blade 1 returns to its first form C1, which at the same time corresponds to the final position of the movable blade 1, overlapping the second blade 2, in the closed position of the clasp.

Figure 8:
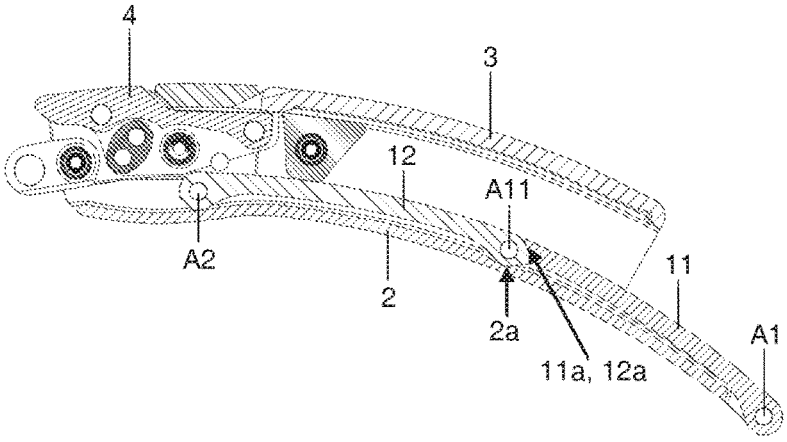
FIG. 8 depicts a view of the clasp according to the first variant of the first embodiment of the invention in a closed configuration.

In this embodiment, the second blade 2 advantageously exhibits a hollow surface forming a housing 2*a* to accommodate the central articulation A11 of the movable blade 1, as can be seen in FIG. 8, which is conducive to the rotation of the second part 12 relative to the axis of articulation A11, whereas the first part 11 is already in place against the blade 2, in the intermediate configuration, and whereas the rotation of the two blades 1, 2 between them about their axis of articulation A1 is finalized. This housing 2*a* may be formed by a light countersink 2*a* made in the body of the second blade 2.

In the major part of this operation of the clasp, in particular during rotation of the movable blade 1 relative to the axis of articulation A1, the two parts 11, 12 of the movable blade 1 continue to make contact via respective abutments, or have a reduced displacement, and the additional articulation A11 of the movable blade 1 compared to the prior art does not cause any obstruction in the operation.

It should be noted that the clasp according to the embodiment of the invention is equipped with a locking device, which makes it possible to keep the two blades 1, 2 secured to each other, in the closed configuration of the clasp, as depicted by FIG. 8. The invention does not relate specifically to the device for locking and/or unlocking the blades, but it is advantageously compatible with a user-friendly and secure locking device, which is particularly effective, which resembles the locking device described in document EP1654950.

It should be noted that the two forms C1, C2 of the movable blade are predefined forms, in the sense that they are reached in a unique manner by a voluntary movement of the person wearing the watch until reaching an abutment. One or both of the predefined forms may or may not be stable forms. A stable form may be obtained, for example, by the combination of a certain resistance that is voluntarily imposed in the area of the articulation between the two parts 11, 12 about the axis of articulation A1 and the abutments.

The two parts 11, 12 of the movable blade have been selected to be of approximately the same length, their axis of articulation A11 being positioned substantially in the middle of the movable blade 1. As a variant, these parts could exhibit a different length.

Naturally, the embodiment is not limited to the example illustrated above. More particularly, the movable blade 1 may comprise more than two articulated parts. By way of example, FIGS. 9 to 12 illustrate a second variant embodiment, in which the movable blade 1 comprises four parts 11, 12, 13, 14, which are articulated in pairs by respective axes of articulation A11, A12 and A13. Each of these articulations has a similar appearance to the previously described articulation A11, with a displacement limited by abutments, defining two predetermined positions, as illustrated, for example, with the two positions of the articulation A13 by FIGS. 11 and 12, with the help of the respective first abutments 13*a*, 14*a* and second abutments 13*b*, 14*b* of the two parts 13, 14. The angular displacement of the parts 12, 13, 14 relative to the parts 11, 12, 13 respectively is in the order of 30° in this case. The angular displacement of the different parts depends, in particular, on the number of articulations. In general, the amplitude of displacement of the different parts of the mobile blade 1 advantageously remains between 20° and 80°.

Figure 9:
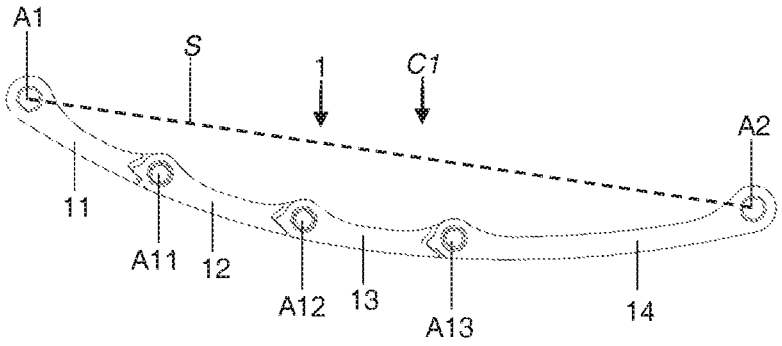
FIG. 9 depicts a movable blade exhibiting a first form according to a second variant of the clasp according to the first embodiment of the invention.

Thus, the movable blade 1 according to this variant of embodiment may also exhibit two predefined forms, depending on whether each articulation A11, A12, A13 is in a position defined by the first abutments or by second abutments. FIG. 9 illustrates the first predefined form C1 of the movable blade, intended to be used in the closed configuration of the clasp.

Figure 10:
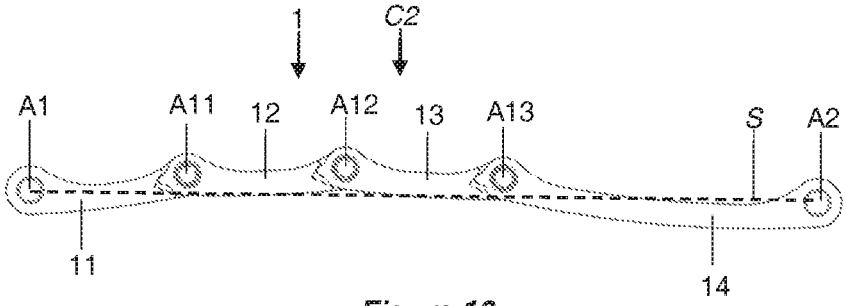
FIG. 10 depicts a movable blade exhibiting a second form according to the second variant of the clasp according to the first embodiment of the invention.
Figure 11:
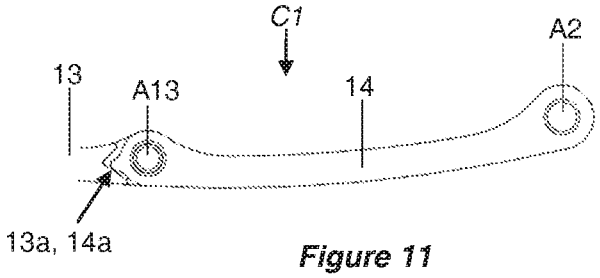
FIG. 11 depicts a detail of the movable blade in its first form according to the second variant of the clasp according to the first embodiment of the invention.
Figure 12:
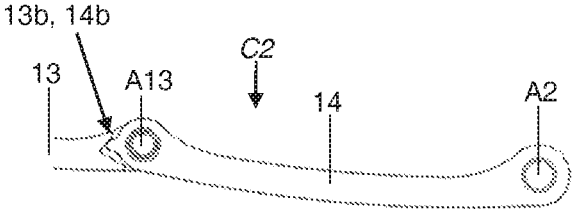
FIG. 12 depicts a detail of the movable blade in its second form according to the second variant of the clasp according to the first embodiment of the invention.
Figure 13:
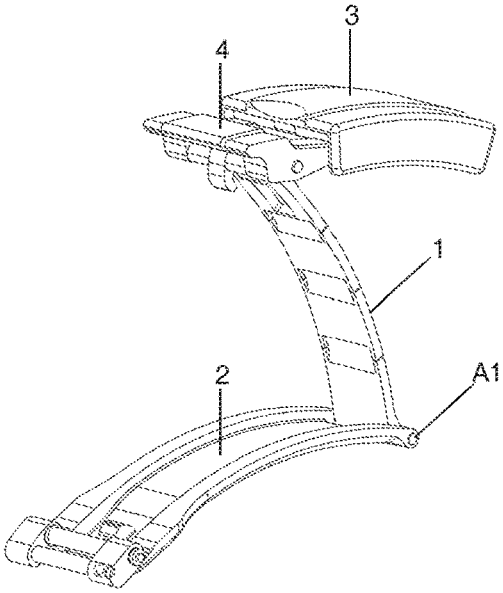
FIG. 13 depicts a view of a clasp according to a second embodiment of the invention in an intermediate configuration.

This first form is convex, when viewed from the wrist, in the deployed configuration, similar to the form in FIGS. 1 and 4. FIG. 10 illustrates the second predefined form C2, which is helpful in optimizing the opening of the clasp for the passage of a hand in the deployed configuration of the clasp. It should be noted that, in this variant embodiment, the second form is predefined in such a way as to follow the segment S approximately, which maximizes the length of the movable blade. The axes of articulation A13, A14, A15 in particular project beyond the segment S. The convex form is thus eliminated. The movable blade 1 even exhibits a slightly concave portion, when viewed from the wrist of the person wearing the wristwatch.

In a general manner, the absolute value of the radius of curvature of the movable blade 1 or of a portion of the movable blade 1 may vary, or may even vary significantly, when the movable blade 1 passes from its first form C1 to its second form C2. In the variant embodiment in FIGS. 9 to 12, the absolute value of the radius of curvature of a portion of a movable blade 1 in its second form C2 is greater, or even significantly greater, than the absolute value of the radius of curvature of the movable blade 1 in its first form C1, for example 1.5 times to 5 times greater. This may make it possible to conform as closely as possible to the parts of a hand exhibiting the strongest curves, such as the contour of the thumb, during the passage of the watch.

FIGS. 13 to 16 illustrate by way of example a second embodiment, in which the movable blade 1 is still divided into four parts 11, 12, 13, 14. Naturally, any other number of parts greater than two would be possible. This second embodiment differs from the first embodiment in respect of the couplings A11, A12, A13 between the different parts, which are formed by zones of reduced thickness of the movable blade 1. In this embodiment, the zones of reduced thickness are obtained by the removal of material, in a symmetrical manner, from the two opposite surfaces of the blade 1. This removal of material takes the form of hollow parts in the form of half circles having a radius r, which permit only a small thickness e of material positioned at the center in the thickness of the movable blade 1.

These couplings thus form necks, of which the behavior resembles that of an articulation A11, A12, A13 of the preceding embodiment. As a variant, other zones of reduced thickness could also form a coupling of the flexible pivot type. In this embodiment, the selected geometry is therefore based on two half circles having a radius r. This radius r of the half circles is preferably at least greater than four times the minimum thickness e of the movable blade 1. This condition allows the stresses to be distributed as effectively as possible and, in particular, allows any concentration of stresses in the middle of the neck to be avoided.

The movable blade 1 may be made advantageously from a super-elastic alloy, such as a nickel-titanium alloy like Nitinol, in order to maximize the thickness e and accordingly to optimize the resistance to traction and to torsion of the movable blade 1 for a given maximum angular displacement of the different blade portions.

Similarly to the first embodiment, a suchlike articulation is angularly delimited by abutments, so as to define the first and second predefined forms of the movable blade 1 in an unambiguous manner by the relative positioning of the different parts 11, 12, 13, 14 of the movable blade 1. These abutments are formed by lateral walls of each part of the blade in the area of each of the necks. In this particular construction, the necks advantageously do not cover the entirety of the transverse section of the movable blade 1, which retains lateral walls of unchanged thickness, although sectioned in order to permit pivoting and to form abutments. As a variant, the abutments could be eliminated, and the angular displacement could be limited by the actual rigidity of the necks. As a variant, the zones of reduced thickness could exhibit a different form, causing deformation of the blade enabling it to distance itself from a pure pivoting movement.

Figure 14:
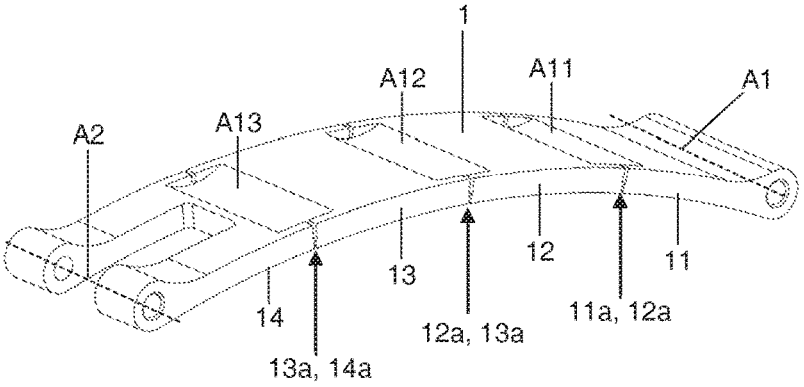
FIG. 14 depicts a view in perspective of a movable blade exhibiting a first form of the clasp according to the second embodiment of the invention.
Figure 15:
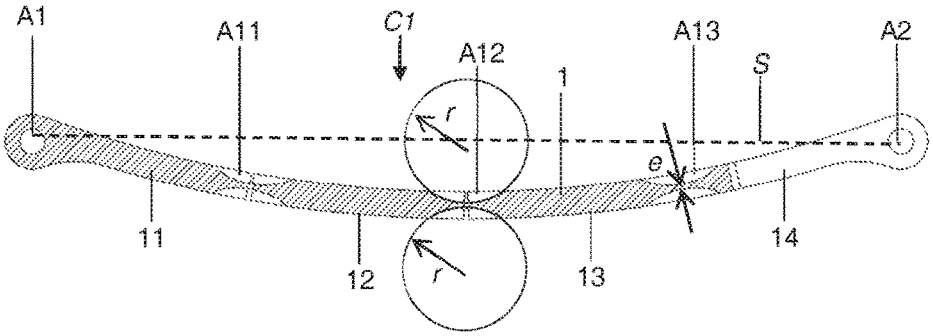
FIG. 15 depicts a view from the side in section of the movable blade exhibiting a first form of the clasp according to the second embodiment of the invention.
Figure 16:
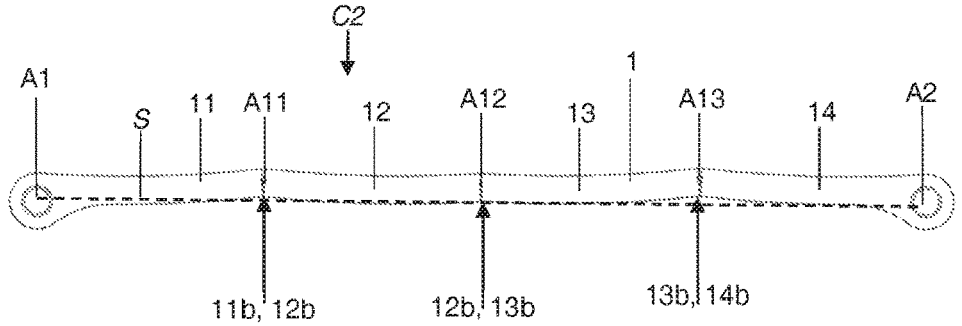
FIG. 16 depicts a view from the side of the movable blade exhibiting a second form of the clasp according to the second embodiment of the invention.

In this second embodiment, the movable blade 1 may accordingly exhibit a first predefined form C1 depicted in FIGS. 14 and 15, and may exhibit a second form depicted in FIG. 16. The first form C1 is similar to the first form of the first embodiment. The second form C2 is similar to the second form of the second variant of the first embodiment depicted in FIG. 10. As previously, in the deployed configuration, if the movable blade 1 exhibits its first form C1, it comprises at least one zone which projects from the first side of the segment S oriented towards the wrist P, as defined previously, and it even exhibits a convex form oriented principally in the direction of the wrist. In its second form C2, the movable blade is substantially rectilinear and comprises at least one zone which projects from the second side of the segment S, opposite the wrist P. More particularly, the articulations A11, A12, A13 project beyond the segment S, opposite the wrist P. Furthermore, the movable blade 1 comprises at least one portion which exhibits a substantially concave form when it is viewed from the wrist of the person wearing the wristwatch.

In the embodiment in FIGS. 13 to 16, the absolute value of the radius of curvature of a portion of the movable blade 1 in its second form C2 is greater, or even significantly greater, than the absolute value of the radius of curvature of the movable blade 1 in its first form C1, for example 1.5 times to 5 times greater.

Of course, it is possible to combine the preceding embodiments and variants. For example, it is possible to envisage a movable blade 1 comprising different types of articulations combining, for example, at least one articulation as proposed in the first embodiment, and at least one articulation as proposed in the second embodiment.

FIGS. 17 to 20 illustrate a third embodiment, in which the movable blade 1 is divided into two parts 11, 12. Naturally, as for the other embodiments, any other number of parts would be possible. This third embodiment differs from the two preceding embodiments in that it does not comprise a coupling of the pivot type between the two parts 11, 12, the behavior of the blade for changing form not being based on an articulation.

Figure 17:
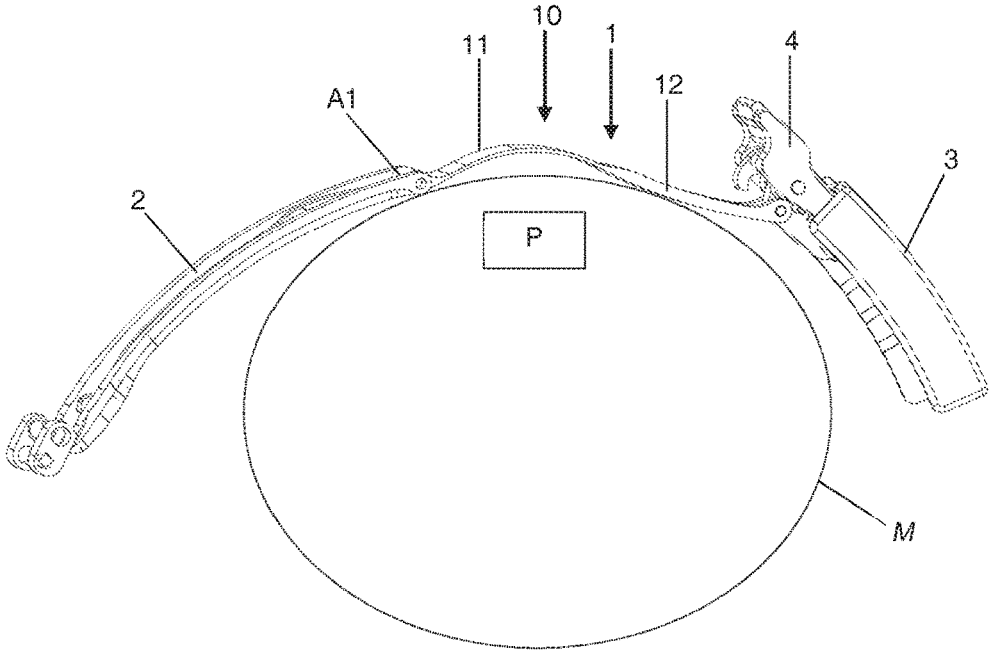
FIG. 17 depicts a view of a clasp according to a third embodiment of the invention in a deployed configuration.
Figure 18:
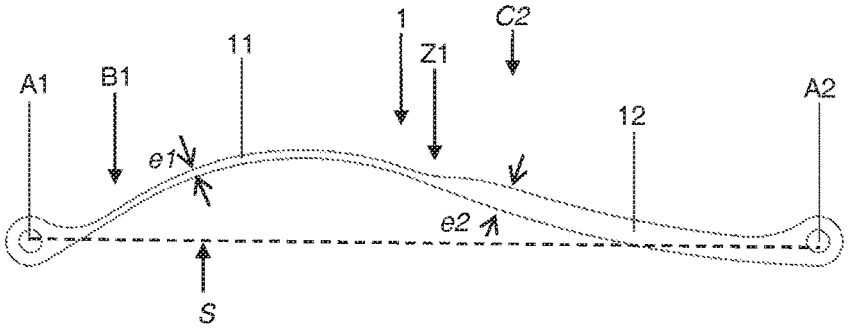
FIG. 18 depicts a view of a movable blade exhibiting a second form of the clasp according to the third embodiment of the invention.

FIGS. 17 and 18 illustrate the movable blade 1 in its second form C2, which is its form at rest. Its two parts 11, 12 are distinguished by a different form and thickness. In the deployed configuration of the clasp depicted in FIG. 17, the movable blade 1 initially comprises a first concave part 11, or rectilinear, when viewed from the wrist P, in proximity to the axis of articulation A1 of the movable blade 1 with the second blade 2, and then a second substantially rectilinear part 12, or substantially convex, when viewed from the wrist P. The movable blade 1 thus comprises a zone of inflection Z1 between the two parts 11, 12. The movable blade 1 is thus configured in order to exhibit in this second form C2 a first part 11, which projects from the side of the segment S, extending between the two axes A1, A2 positioned at its extremities, opposite the wrist P. The preforming of the movable blade 1 thus defines a unique and stable geometry at rest, which corresponds to the second predefined form C2.

The movable blade 1 thus makes it possible to optimize the passage of a hand in the course of positioning the wristwatch on the wrist or in the course of removing the wristwatch from the wrist. In particular, the first part 11 of the movable blade 1 of substantially concave or rectilinear form thus offers an additional passage for the hand of the person wearing the watch compared to the solution that is familiar from the prior art depicted in FIG. 1. A suchlike first part 11 is adapted particularly well, for example, to the passage of the thumb of the wearer's hand.

Figure 19:
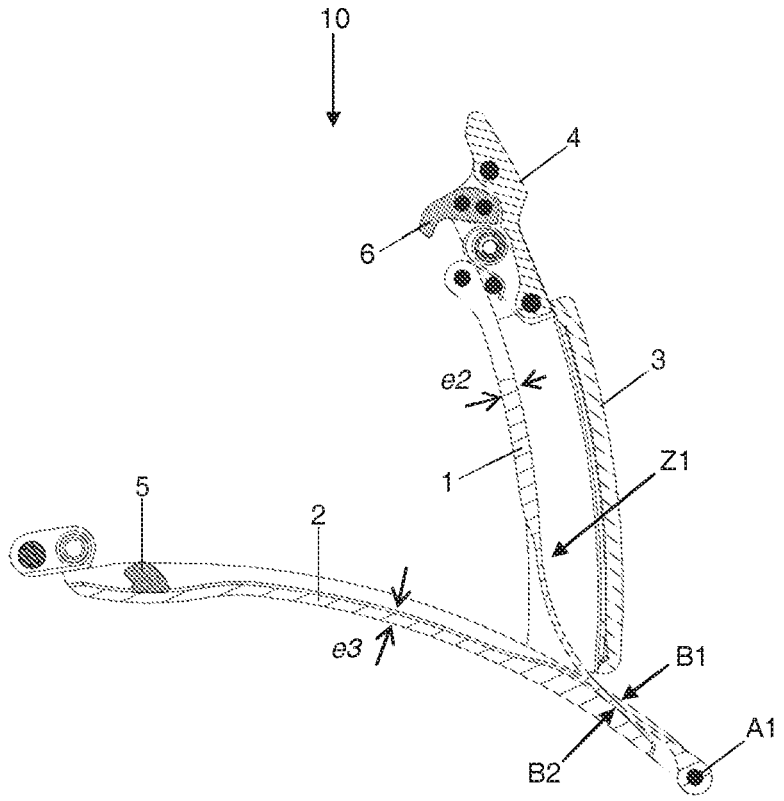
FIG. 19 depicts a view of the clasp according to the third embodiment of the invention in an intermediate configuration.

In the course of closing the clasp, the movable blade 1 pivots towards the second blade 2 about the axis of articulation A1, until the movable blade 1 comes into abutment with the blade 2 in the area of the respective abutment surfaces B1, B2. This intermediate configuration in abutment is illustrated by FIG. 19. In this configuration, the rotation about the axis of articulation A1 is terminated.

Figure 20:
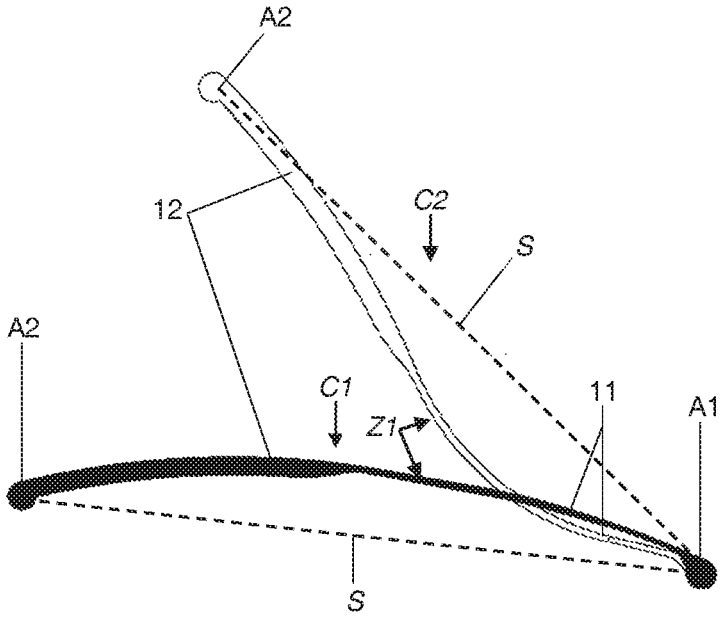
FIG. 20 depicts a view of the movable blade exhibiting a first form and a second form of the clasp according to the third embodiment of the invention.

The person wearing the watch then continues the closing movement of the clasp, which brings about the displacement of the movable blade 1 towards the second blade 2 and an elastic deformation of the movable blade 1. This elastic deformation of the movable blade 1 takes place primarily at the level of the part 11, for example, and can take place in particular at the level of the zone of inflection Z1. The movement continues until closure of the clasp, that is to say until the movable blade 1 has been secured to the second blade 2 of the clasp, for example, by an appropriate locking device 4, 5, 6. The movable blade 1 is thus deformed in such a way as to exhibit a first form C1, in which its curve is substantially constant and is intended to conform as closely as possible to the curve of the blade 2, as well as a wearer's wrist. The first form C1 of the movable blade is illustrated in FIG. 20 in comparison with the second form C2.

As a variant, this third embodiment could be obtained by any geometry of the movable blade 1 exhibiting at least one zone of inflection. It could, therefore, include a plurality of zones of inflection.

Advantageously, in this embodiment, the first part 11 exhibits a thickness e1 that is less than the thickness e2 of the second part 12, such that the first part 11 may be flexible, in particular in comparison with the second part, and may exhibit an optimized bending moment. On the other hand, the second part 12 is considered to be rigid and dimensionally stable in this embodiment, under the influence of the conventional operations of the person wearing the wristwatch.

Preferably, the two thicknesses e1, e2 of each part 11, 12 respectively verify:

e1<e2/2, or e1<e2/3;

e2~e3, that is to say that the thicknesses e2 and e3 are substantially equal, where e3 is the constant thickness of the blade 2;

e1~0.3 mm and e2~1 mm.

The thickness e1 of the first part 11 may be constant for the entire length of the first part 11. Similarly, the thickness e2 of the second part 12 may be constant for the entire length of the second part 12. Alternatively, these thicknesses e1 and/or e2 may vary, in a continuous or discontinuous manner, in such a way as to propose a movable blade 1 that is deformable in flexion, while being sufficiently resistant to tension and resistant to torsion with respect to predefined criteria. The cross section of each of the parts may likewise vary in such a way as to meet these criteria.

According to a variant of the third embodiment, not depicted here, the movable blade 1 may simply exhibit a variable thickness over its length, without a zone of inflexion. This variable thickness forms a compromise which allows it to achieve sufficient flexibility for it to deform elastically between two different forms, while preserving sufficient mechanical rigidity for its operation.

Advantageously, the movable blade 1 may be made from a super-elastic alloy, for example a nickel-titanium alloy such as Nitinol.

Preferably, the elastic potential energy accumulated by the elastic deformation of the movable blade 1 in its first form, in the closed configuration of the clasp, may be utilized in order to contribute to the locking and/or unlocking function of the movable blade 1, in cooperation with a locking device 4, 5, 6 of the two blades 1, 2 of the clasp. In particular, the elastic potential energy accumulated by the elastic deformation of the movable blade 1 in its first form may be utilized in order to facilitate the opening of the clasp, namely to permit the distancing of the movable blade 1 relative to the second blade 2, by its pivoting about the axis A1 of articulation, without a significant contribution by the person wearing the wristwatch.

The invention is illustrated in the context of a clasp having deployant blades comprising two blades 1, 2. As a variant, the clasp could exhibit any architecture other than that depicted in the figures. It could comprise a greater number of deployant blades. For example, it could comprise three blades, of which two blades are movable blades arranged respectively at the two extremities of a third central blade and are locked in the central part of this third blade in the closed configuration of the clasp. In this case, one movable blade or the two movable blades could comprise a plurality of parts that are movable in relation to one another in order to obtain two predefined forms.

The movable blade is illustrated as being folded back onto another blade in the closed configuration, its closed position being fixed by a locking device. As a variant, a simple retaining device, for example by a simple snap-fit, and/or any other locking device may be provided for the temporary and releasable attachment of the movable blade to the clasp in the closed configuration of the clasp. As a variant, this movable blade could occupy a different position in the closed configuration of the clasp, for example totally interlocked or partially interlocked in another blade. More generally, the movable blade thus extends in a continuous manner on its entire length substantially along the surface of a second blade in the closed configuration of the clasp.

According to the architecture of the clasp, the movable blade may adopt a plurality of geometries. A movable blade of a clasp is defined in the sense of the invention as a blade comprising an articulation in the area of a first extremity, about which it pivots in relation to another blade of the clasp for the passage from a closed configuration to a deployed configuration of the clasp, or vice versa, and which extends continuously from its first extremity towards a second extremity in the closed configuration of the clasp.

This movable blade comprises two predefined forms, that is to say that these forms may be obtained in a repeated and reliable manner, in an automatic manner or under the effect of a given actuation by a person wearing the clasp. These forms may be predefined in different ways, by the geometrical and/or mechanical properties of the movable blade. In addition, a predefined form may or may not be stable: a form is stable when it is maintained automatically once it has been reached, in the absence of any stress exerted by a wearer.

The invention is illustrated on the basis of a clasp intended for a bracelet, said bracelet being intended for a wristwatch. The invention thus also relates to a bracelet and to a wristwatch as such, comprising a suchlike clasp. As a variant, the clap may be associated with any other bracelet, for any object other than a watch to be secured on a wrist or any other part. This object may be a "Smart" watch, an underwater diving accessory such as a depth gauge or an underwater diving computer, for example, or even a jewelry component.

The invention claimed is:

1. A clasp having deployant blades for a wristband, wherein the clasp comprises at least two blades including a first movable blade and a second blade, the first movable blade comprising at least two parts that are interconnected in an articulated manner by an articulation, and the first movable blade articulated directly to the second blade on an area of a first extremity of the first movable blade, a cover articulated directly to the first movable blade at a second extremity of the first movable blade, the clasp being able to adopt a closed configuration, in which:

the first movable blade exhibits a first predefined form such that the first moveable blade extends in a continuous manner for an entire length of the first movable blade, substantially along a surface of the second blade; and the second extremity of the first movable blade is in a fixed position;

the clasp being able to adopt a deployed configuration, in which the second extremity of the first movable blade is free from the fixed position, the first movable blade thus having the ability to be moved away from the surface of the second blade, wherein, in the deployed configuration, the first movable blade is able to exhibit a second predefined form which is different from the first predefined form, in order to optimize a passage surface for a hand of a person wearing the clasp.

2. The clasp as claimed in claim 1, wherein the first predefined form of the first movable blade is a convex, curved form, when viewed from a wrist, in the deployed configuration of the clasp, wherein the first predefined form is able to conform to a form of the wrist of the person wearing the clasp in the closed configuration of the clasp.

3. The clasp as claimed in claim 1, wherein at least one selected from the first predefined form and the second predefined form of the first movable blade is a stable predefined form.

4. The clasp as claimed in claim 3, wherein each of the at least two parts of the first movable blade comprises respectively two abutments in an area of the articulation, each delimiting a position of the at least two parts of the first movable blade and defining the first and second predefined forms.

5. The clasp as claimed in claim 1, wherein the first movable blade comprises at least one articulation comprising an axis of articulation, which the as least two parts of the first movable blade are interconnected in the articulated manner.

6. The clasp as claimed in claim 1, wherein the first movable blade comprises at least one articulation comprising a zone of reduced thickness forming a pivot coupling between the at least two parts of the first movable blade disposed to either side of the zone of reduced thickness.

7. The clasp as claimed in claim 1, wherein at least one articulation permits a rotation having an amplitude of between 20 and 80 degrees inclusive between the at least two articulated parts of the first movable blade.

8. The clasp as claimed in claim 1, wherein the first movable blade comprises at least one zone of inflection permitting an elastic deformation of the first movable blade.

9. The clasp as claimed in claim 1, wherein the first movable blade exhibits a second stable position intended for the deployed configuration of the clasp, wherein the first movable blade comprises the at least two parts distributed around a zone of inflection.

10. The clasp as claimed in claim 8, wherein the first movable blade comprises the at least two parts exhibiting at least one selected from the group consisting of a different curve, different thicknesses and opposed convexities.

11. The clasp as claimed in claim 8, wherein the first movable blade comprises the at least two parts of different respective thicknesses (e1, e2), meeting the following conditions:

$$e1<e2/2, \text{ or } e1<e2/3;$$

and wherein e1 is a thickness of a first part, e2 is a thickness of a second part, wherein the thickness e2 of the second part of the first movable blade is close to a thickness e3 of the second blade.

12. The clasp as claimed in claim 1, wherein the first movable blade is made from a super-elastic alloy.

13. The clasp as claimed in claim 1, wherein the clasp is a clasp having two deployant blades of substantially the same length.

14. A wristband, wherein the wristband comprises at least one clasp having deployant blades as claimed in claim 1.

15. A wristwatch, wherein the wristwatch comprises at least one wristband as claimed in claim 14.

16. The clasp as claimed in claim 2, wherein the second predefined form of the first movable blade comprises at least one selected from the group consisting of (i) at least one substantially rectilinear and/or concave part, when viewed from the wrist, in the deployed configuration of the clasp and (ii) at least one part projecting beyond a segment delimited by the two extremities of the first movable blade, thereby moving away from the wrist of the person wearing the clasp in the deployed configuration of the clasp.

17. The clasp as claimed in claim 12, wherein the first movable blade is made from a nickel-titanium alloy.

18. The clasp as claimed in claim 1, wherein the first movable blade exhibits a length of between 20 and 60 mm.

19. The clasp as claimed in claim 1, wherein the clasp is a clasp having two blades that are movable about a third center blade.

20. A clasp having deployant blades for a wristband, wherein the clasp comprises at least two blades including a first movable blade and a second blade, the first movable blade articulated directly to the second blade on an area of a first extremity of the first movable blade, the clasp being able to adopt a closed configuration, in which:

the first movable blade exhibits a first predefined form such that the first movable blade extends in a continuous manner for an entire length of the first movable blade, substantially along a surface of the second blade; and the second extremity of the first movable blade is in a fixed position;

the clasp being able to adopt a deployed configuration, in which the second extremity of the first movable blade is free from the fixed position, the first movable blade thus having the ability to be moved away from the surface of the second blade, wherein, in the deployed configuration, the first movable blade is able to exhibit a second predefined form which is different from the first predefined form, in order to optimize a passage surface for a hand of a person wearing the clasp, and wherein the first movable blade comprises at least one zone of inflection permitting an elastic deformation of the first movable blade.

21. The clasp as claimed in claim 20, wherein the first movable blade exhibits a second stable position intended for the deployed configuration of the clasp, wherein the first movable blade comprises at least two parts distributed around a zone of inflection.

22. The clasp as claimed in claim 20, wherein the first movable blade comprises two parts exhibiting at least one selected from the group consisting of a different curve, different thicknesses and opposed convexities.

23. The clasp as claimed in claim 20, wherein the first movable blade comprises two parts of different respective thicknesses (e1, e2), meeting the following conditions:

$$e1<e2/2, \text{ or } e1<e2/3;$$

and wherein e1 is a thickness of a first part, e2 is a thickness of a second part, wherein the thickness e2 of the second part of the first movable blade is close to a thickness e3 of the second blade.

24. The clasp as claimed in claim 20, wherein the first movable blade is made from a super-elastic alloy.

* * * * *